US010858917B2

(12) United States Patent
Zhang et al.

(10) Patent No.: US 10,858,917 B2
(45) Date of Patent: Dec. 8, 2020

(54) EXPANDABLE LINER HANGER

(71) Applicant: CNPC Engineering Technology R&D Company Limited, Beijing (CN)

(72) Inventors: Quanli Zhang, Beijing (CN); Hongwei Yin, Beijing (CN); Wanjun Li, Beijing (CN); Huijuan Guo, Beijing (CN); Guojun Liu, Beijing (CN); Binggui Xu, Beijing (CN); Gang Chen, Beijing (CN); Yingjie Zhu, Beijing (CN); Gang Wang, Beijing (CN); Shaohua Zhou, Beijing (CN); Zhitong Liu, Beijing (CN); Yongliang Yu, Beijing (CN); Mingmin He, Beijing (CN); Tao Jia, Beijing (CN); Jianli Wang, Beijing (CN); Mingjie Lv, Beijing (CN); Fei He, Beijing (CN)

(73) Assignee: CNPC ENGINEERING TECHNOLOGY R&D COMPANY LIMITED, Beijing (CN)

( * ) Notice: Subject to any disclaimer, the term of this patent is extended or adjusted under 35 U.S.C. 154(b) by 0 days.

(21) Appl. No.: 16/389,188

(22) Filed: Apr. 19, 2019

(65) Prior Publication Data

US 2020/0332629 A1 Oct. 22, 2020

(51) Int. Cl.

| | |
|---|---|
| ***E21B 43/10*** | (2006.01) |
| ***E21B 17/10*** | (2006.01) |
| ***E21B 33/14*** | (2006.01) |

(52) U.S. Cl.

CPC ..... *E21B 43/108* (2013.01); *E21B 17/1078* (2013.01); *E21B 33/14* (2013.01)

(58) Field of Classification Search

CPC ..... E21B 43/108; E21B 17/1078; E21B 33/14

See application file for complete search history.

(56) References Cited

U.S. PATENT DOCUMENTS

| | | | | |
|---|---|---|---|---|
| 2,812,025 | A * | 11/1957 | Doherty | E21B 43/086 166/207 |
| 6,012,523 | A * | 1/2000 | Campbell | E21B 17/1014 166/207 |
| 2004/0011534 | A1* | 1/2004 | Simonds | E21B 7/20 166/384 |
| 2014/0054047 | A1* | 2/2014 | Zhou | E21B 43/106 166/382 |
| 2018/0119527 | A1* | 5/2018 | Jabs | E21B 43/103 |
| 2018/0202267 | A1* | 7/2018 | Xu | E21B 29/10 |

* cited by examiner

*Primary Examiner* — James G Sayre
(74) *Attorney, Agent, or Firm* — Volpe Koenig

(57) ABSTRACT

The present invention discloses an expandable liner hanger system comprising a central pipe and an expandable pipe, with an expansion cone provided therebetween the central pipe and expandable pipe in a way that the expansion cone is movable along the central pipe, so that the expandable pipe is expanded; wherein, the expansion cone comprises an expansion cone seat move along the central pipe, and an expansion cone sleeve fitted over the expansion cone seat, the connection between the expansion cone seat and the expansion cone sleeve is configured in a way that the expansion cone sleeve can move upward together with the expansion cone seat along the central pipe so that the expandable pipe is expanded, and the central pipe can drive the expansion cone seat to disengage from the expansion cone sleeve.

13 Claims, 10 Drawing Sheets

EXPANDABLE LINER HANGER

FIELD OF THE INVENTION

The present invention relates to the field of oil and gas wellbore construction, particularly to an expandable liner hanger.

BACKGROUND OF THE INVENTION

Liner hangers have been widely utilized as petroleum exploitation is continued and deep wells and ultra-deep wells become more and more. Compared with traditional well construction methods, liner hangers have the following advantages. Firstly, the cost of tubular is reduced; specifically, since the liner is hung from the upper tubular, all tubulars above the hanger are omitted. Secondly, because liner weight is less than the whole casing string in a deep well, less horsepower rig may be used to drill a deeper well, rather than a large horsepower rig is needed, hence service cost of drilling rig may be reduced. In addition, the success rate and operating efficiency of well cementation are improved.

The standard liner hangers with top packers usually utilize a cone and slip combination to hang the liner to the upper tubular. Numerous field cases showed that they sometime may fail in a proper setting/sealing, resulting in severely compromised effort and poor cement due to restricted flow passages area across the liner hanger after slips are activated, that may create a backpressure and even induce downhole losses while cementing.

In the last decade or so expandable liner hanger technology has been developed to address these problems with the advantages of much improved hanging success together with a much better pressure zonal isolation because of multiple reliable hanging/sealing elements. Expandable liner hanger is essentially a short section of expandable tubular with several bands of elastomer seals, that is expanded by a solid expansion cone driven by a high hydraulic pressure. The expansion cone moves typically from top down, so that the expansion tool assembly could be easily retrieved if encountering any major problem, such as a lack of available room potentially due to a significant solid accumulation between expandable liner hanger and previous casing post liner cementing operation, particularly in a highly deviated or horizontal section of a well. If that happens, it may prevent further expansion and even leads possibly to stuck cone, ending up with a partially or poorly expanded liner hanger, which may not meet the operational requirements of liner hanger for the well.

SUMMARY OF THE INVENTION

To address the above mentioned problem, the present invention discloses a new expandable liner hanger system, with a bottom up hydraulic expansion process that allows optional ball seating for pressure isolation in case of normal cement plug failure, as well as mechanical over-pull (if required) to overcome a tight-hole situation (due to potential solids behind the hanger) and releasable cone in event of stuck cone, in addition to enhanced liner hanger seal elements consisting of both elastomer bands and metal rings, ultimately offering an assured chance of successfully delivering a reliable liner hanger.

To attain the object described above, in an aspect, the present invention provides an expandable liner hanger system, comprising a central pipe and an expandable pipe outside the central pipe, with an expansion cone provided between the central pipe and the expandable pipe in a way that the expansion cone is movable along the central pipe, so that the expandable pipe is expanded;

Wherein, the expansion cone comprises an expansion cone seat that can move along the central pipe, and an expansion cone sleeve fitted over the expansion cone seat, the connection between the expansion cone seat and the expansion cone sleeve is configured in a way that the expansion cone sleeve can move upward together with the expansion cone seat along the central pipe so that the expandable pipe is expanded, and the central pipe can drive the expansion cone seat to disengage from the expansion cone sleeve.

Preferably, the expansion cone seat is connected with the expansion cone sleeve via a threaded connection, the central pipe can drive the expansion cone seat to rotate such that the expansion cone seat can screwed out from the expansion cone sleeve.

Preferably, a step is formed on the external surface of the central pipe, the expansion cone seat is at the upper end of the step and the expansion cone seat is fitted and connected with the central pipe via a spline so as to transmit rotating torque from the central pipe.

Preferably, the expansion cone seat is connected with the expansion cone sleeve via at least one shear pin, the central pipe is configured such that the shear pin can be broken and the expansion cone seat can disengage from the expansion sleeve when rotating, pulling or pushing the expansion cone seat by the central pipe.

Preferably, a fluid-filled cavity is formed between the central pipe and the expandable pipe at the side of the lower end of the expansion cone, the side wall of the central pipe has an aperture that communicates with the fluid-filled cavity, and the fluid flowing into the central pipe can enter into the fluid-filled cavity via the aperture and push the lower end of the expansion cone to move upward.

Preferably, the expandable liner hanger system further comprising a well cementing accessory and a rubber plug, the well cementing accessory is connected to the lower end of the central pipe and has a center hole, and the rubber plug is used to be placed in the central pipe and can move to the well cementing accessory under the action of the pressurized fluid in the central pipe so as to be stopped by the well cementing accessory;

Wherein, the well cementing accessory is connected to the central pipe via a shear pin, which can be sheared off when the rubber plug and the well cementing accessory are pushed to move under the pressure effect of the fluid above the rubber plug.

Preferably, the central pipe comprises a main pipe body and a carrying sleeve connected to the lower end of the main pipe body, and the well cementing accessory is connected to the carrying sleeve via the shear pin.

Preferably, the lower end of the expandable pipe is connected with a connecting sleeve configured to connect a liner, the lower end of the carrying sleeve is divided along the circumferential direction to form a plurality of collet fingers, and a collet finger head configured to stop at the lower end face of the connecting sleeve is provided on the outer surface of at least one of the collet fingers;

When the central pipe moves upward after the well cementing accessory disengages downward from the carrying sleeve, the collet fingers can deform inward so that the collet finger heads move upward out of the lower end of the double pin thread connecting sleeve.

Preferably, the carrying sleeve is connected with the main pipe body through a threaded connection; or, the connecting sleeve is connected with the expandable pipe through a threaded connection.

Preferably, the expandable liner hanger system further comprising a tripping ball to be placed in the central pipe, and the central pipe is provided with a stop structure therein, which is configured to stop the tripping ball below the aperture, and the internal flow passage in the central pipe can be blocked when the tripping ball is fitted with the stop structure.

Preferably, the central pipe comprises a main pipe body and a carrying sleeve connected to the lower end of the main pipe body, and the stop structure is a tapered hole section that is tapered in the downward direction in the carrying sleeve.

Preferably, a dual-purpose sleeve that supports between the central pipe and the expandable pipe is provided at a side of the upper end of the expansion cone, the dual-purpose sleeve acts as a centralizer and also a debris catcher to prevent any solids falling into the critical expandable interval.

Preferably, the central pipe further comprises a connecting pipe configured to connect a drill rod, the connecting pipe is provided at the upper end of the central pipe.

In the expandable liner hanger system provided in the present invention, the expandable pipe can be expanded as the expansion cone moves along the central pipe, so that the expandable pipe is tightly fixed to the inner wall of the external casing in the well. If the expansion cone can't move further due to any unexpected obstruction behind the expandable pipe, the central pipe may be rotated so that the expansion cone seat is driven by the central pipe to disengage from the expansion cone sleeve and is lifted out of the well together with the central pipe, while the expansion cone sleeve is left in the well. Thus, additional milling tools may be inserted into the well for clean-out and a sufficient wellbore pass-through diameter is ensured, so that the well construction can be continued. The technical scheme provided in the present invention can ensure wellbore accessibility in case that the expandable pipe fails to expand.

BRIEF DESCRIPTION OF SYMBOLS

1—central pipe; 11—main pipe body; 111—aperture; 112—step; 12—carrying sleeve; 121—collet finger; 122—collet finger head; 123—tapered hole section; 13—connecting pipe; 2—expandable pipe; 21—metal seal ring; 22—elastic seal ring; 3—expansion cone; 31—expansion cone seat; 32—expansion cone sleeve; 4—connecting sleeve; 5—well cementing accessory; 6—rubber plug; 7—shear pin; 8—tripping ball; 9—fluid-filled cavity; 10—dual-purpose sleeve; 20—liner; 30—external casing; 40—cement slurry; 50—rock formation

DETAILED DESCRIPTION OF THE EMBODIMENTS

Hereunder some embodiments of the present invention will be detailed with reference to the accompanying drawings. It should be understood that the embodiments described here are only provided to describe and explain the present invention rather than constitute any limitation to the present invention.

It should be noted that the embodiments and the features in the embodiments can be combined freely, provided that there is no confliction among them.

In the description of the present invention, it should be understood that the orientation or position relations indicated by terms "center", "longitudinal", "transverse", "length", "width", "thickness", "above", "below", "left", "right", "vertical", "horizontal", "top", "bottom", "axial", "radial", or "circumferential", etc., are based on the orientation or position relations indicated in the accompanying drawings. They are used only to ease and simplify the description of the present invention, rather than indicate or imply that the involved device or component must have a specific orientation or must be constructed and operated in a specific orientation. Therefore, the use of these terms shall not be deemed as constituting any limitation to the present invention. In addition, "inside" and "outside" usually refer to inside and outside with respect to the outlines of the components.

Figure 1:
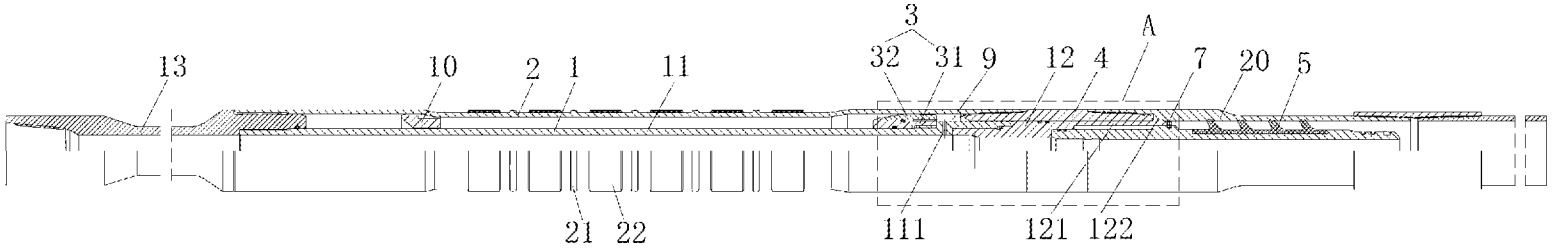
FIG. 1 is a schematic diagram illustrating the expandable liner hanger provided in an embodiment according to the present invention when the expandable liner hanger is just lowered into a well.

The present invention provides an expandable liner hanger system, which, as shown in FIG. 1, comprises a central pipe 1 and an expandable pipe 2 outside the central pipe 1, with an expansion cone 3 provided between the central pipe 1 and the expandable pipe 2 in a way that the expansion cone 3 is movable along the central pipe 1, so that the expandable pipe 2 is expanded.

Wherein, the expansion cone 3 comprises an expansion cone seat 31 that can move along the central pipe 1, and an expansion cone sleeve 32 fitted over the expansion cone seat 31, the connection between the expansion cone seat 31 and the expansion cone sleeve 32 is configured in a way that the expansion cone sleeve 32 can move upward together with the expansion cone seat 31 along the central pipe 1 so that the expandable pipe 2 is expanded, and the central pipe 1 can drive the expansion cone seat 31 to disengage from the expansion cone sleeve 32.

Preferably, the expansion cone seat 31 is connected with the expansion cone sleeve 32 via a threaded connection, the central pipe 1 can drive the expansion cone seat 31 to rotate such that the expansion cone seat 31 can screwed out from the expansion cone sleeve 32.

Specifically, a step 112 is formed on the external surface of the central pipe 1, the expansion cone seat 31 is at the upper end of the step 112 and the expansion cone seat 31 is fitted and connected with the central pipe 1 via a spline so a rotating torque can be transmitted across it. when the central pipe 1 drives the expansion cone seat 31 to rotate via the spline, the threaded connection between the expansion cone seat 31 and the expansion cone sleeve 32 can be unscrewed.

Of course, those skilled in the art can understand that the connection structure in which the expansion cone seat 31 can disengage from the expansion cone sleeve 32 is not limited to threaded connection. For example, a connecting component, such as at least one shear pin may be provided between the expansion cone seat 31 and the expansion cone sleeve 32, and may be broken when rotating, pulling or pushing the expansion cone seat 31 by the central pipe, so that the expansion cone seat 31 can disengage from the expansion cone sleeve 32. Other embodiments may also be possible.

In the expandable liner hanger system provided in the present invention, the expandable pipe 2 can be expanded as the expansion cone 3 moves along the central pipe 1, so that the expandable pipe 2 is tightly fitted and fixed to the inner wall of the external casing 40 in the well. If the expansion cone 3 can't move further and expand the expandable pipe 2 in any emergency, e.g., sand and gravel, solids or even metal junks, etc. are entrained between the central pipe 1 and the expandable pipe 2, the central pipe 1 may be rotated so that the expansion cone seat 31 is driven by the central pipe 1 to rotate and thereby disengage from the expansion cone sleeve 32 and is lifted out of the well together with the central pipe 1, while the expansion cone sleeve 32 is left in the well. Then, additional milling tools may be inserted into the well to ensure a sufficient wellbore pass-through diameter, so that the well construction can be continued. Therefore, the technical scheme provided in the present invention can ensure wellbore accessibility in case that the expandable pipe fails to expand.

Hereunder the technical scheme provided in the present invention will be further detailed in embodiments with reference to the accompanying drawings.

Figure 2:
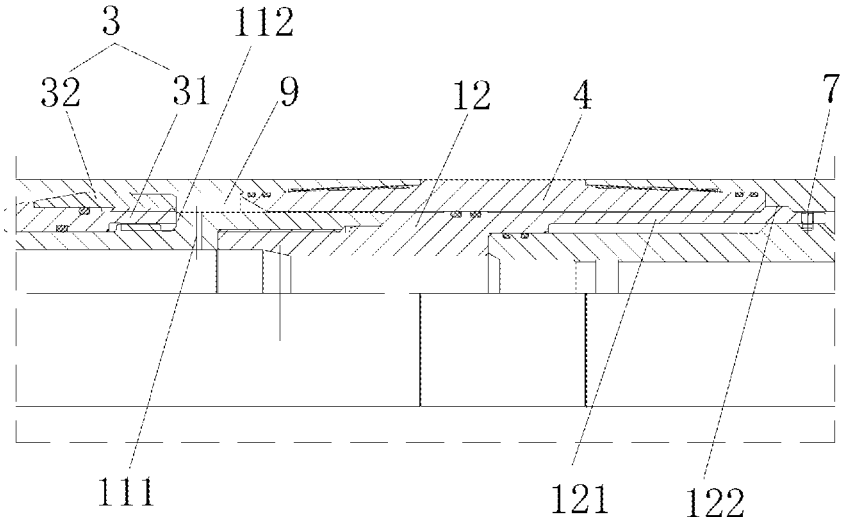
FIG. 2 is an enlarged view of portion A in FIG. 1.

In an embodiment of the present invention, as shown in FIGS. 1 and 2, fluid-filled cavity 9 is formed between the central pipe 1 and the expandable pipe 2 at the side of the lower end of the expansion cone 3, the side wall of the central pipe 1 has an aperture 111 that communicates with the cavity 9, and the fluid flowing into the central pipe 1 can enter into the cavity 9 via the aperture 111 and push the lower end of the expansion cone 3 to move upward by a relatively large hydraulic pressure, so that the expandable pipe 2 is expanded.

Figure 4:
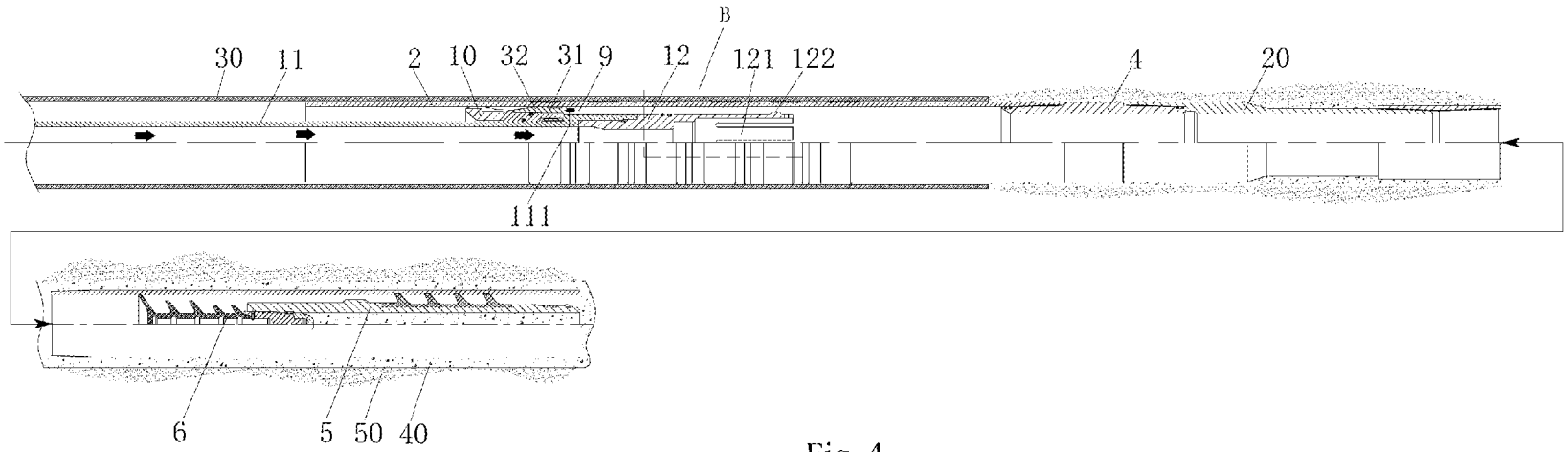
FIG. 4 is a schematic diagram illustrating the expandable liner hanger provided in the present invention in an expansion and hanging operation state.

There is a dual-purpose sleeve 10 that acts as a centralizer between the central pipe 1 and the expandable pipe 2 at the upper elastic seal ring end of the expansion pipe 2. The sleeve 10 can also function as a debris catcher to prevent any solids falling into the critical expansion interval. When the expansion cone 3 moves upward and expands and the central pipe 1 is lifted upward, the sleeve 10 can move upward together with the expansion cone 3 (as shown in FIG. 4).

In this embodiment, the expandable liner hanger system further comprises a well cementing accessory 5 that is connected to the lower end of the central pipe 1 and has a center hole, and a rubber plug 6 that is to be placed in the central pipe 1 and can move to the well cementing accessory 5 under the action of the fluid in the central pipe 1 and is stopped at the entry point by the well cementing accessory 5 because of a restricted passage diameter that is smaller than the rubber plug 6 nominal out-diameter. Wherein, the well cementing accessory 5 is connected to the central pipe 1 via a shear pin 7, which can be sheared off when the rubber plug 6 and the well cementing accessory 5 are pushed to move downward under the pressure effect of the fluid above the rubber plug 6.

Specifically, as shown in FIGS. 1 and 2, the central pipe 1 comprises a main pipe body 11 and a carrying sleeve 12 connected to the lower end of the main pipe body 11, and the well cementing accessory 5 is connected to the carrying sleeve 12 via a shear pin 7. Preferably, the carrying sleeve 12 is connected to the main pipe body 11 through a threaded connection. The carrying sleeve 12 and the main pipe body 11 are designed as separate components for the convenience of manufacturing. Of course, alternatively the main pipe body 11 and the carrying sleeve 12 may be formed integrally.

In addition, the central pipe 1 further comprises a connecting pipe 13 configured to connect a drill rod at the upper end of the central pipe 1. The inner wall of the connecting pipe 13 at the upper end has a female or box thread form, and the drill rod may be connected by means of a male or pin thread form.

In this embodiment, the lower end of the expandable pipe 2 is connected with a connecting sleeve 4 configured to connect a liner 20; preferably, the expandable pipe 2 is connected with the connecting sleeve 4 through a threaded connection. Via the connecting sleeve 4, the expandable pipe 2 may be connected with a liner 20 conveniently.

Figure 5:
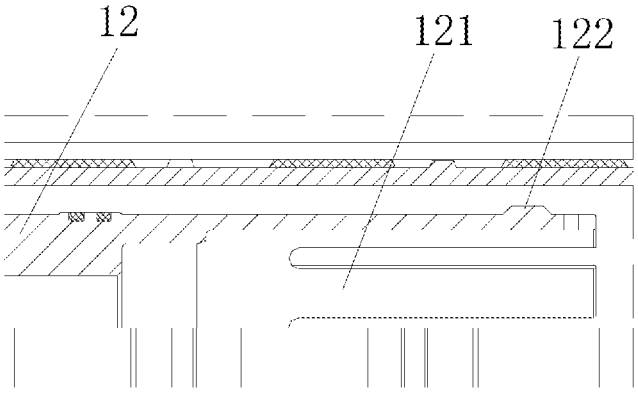
FIG. 5 is an enlarged view of portion B in FIG. 4.

Preferably, as shown in FIGS. 2 and 5, the lower end of the carrying sleeve 12 is divided along the circumferential direction to form a plurality of collet fingers 121, a collet finger head 122 configured to stop at the lower end face of the connecting sleeve 4 is provided on the outer surface of at least one of the collet fingers 121. When the central pipe 1 moves upward after the well cementing accessory 5 disengages downward from the carrying sleeve 12, the collet fingers 121 can deform inward so that the finger head 122 moves upward out of the lower end of the connecting sleeve 4. Wherein, before the shear pin 7 is sheared off, the collet fingers 121 can't deform inward in the radial direction owing to the existence of the well cementing accessory 5, as shown in FIG. 2. Therefore, the collet finger heads 122 will stop the central pipe 1 from moving upward with respect to the expandable pipe 2. After the shear pin 7 is sheared off under the action of pressure, the well cementing accessory 5 is pushed to move downward under the pressure. At this point, when the central pipe 1 is lifted upward, the collet fingers 121 at the lower end of the carrying sleeve 12 can deform inward in the radial direction owing to their elasticity, and thereby the collet finger heads 122 move inward and disengage from the end of the connecting sleeve 4, so that the central pipe 1 can move upward. This is the adopted mechanism to carry a substantial weight of a liner into a wellbore and release from the liner after cementing operation.

Figure 3:
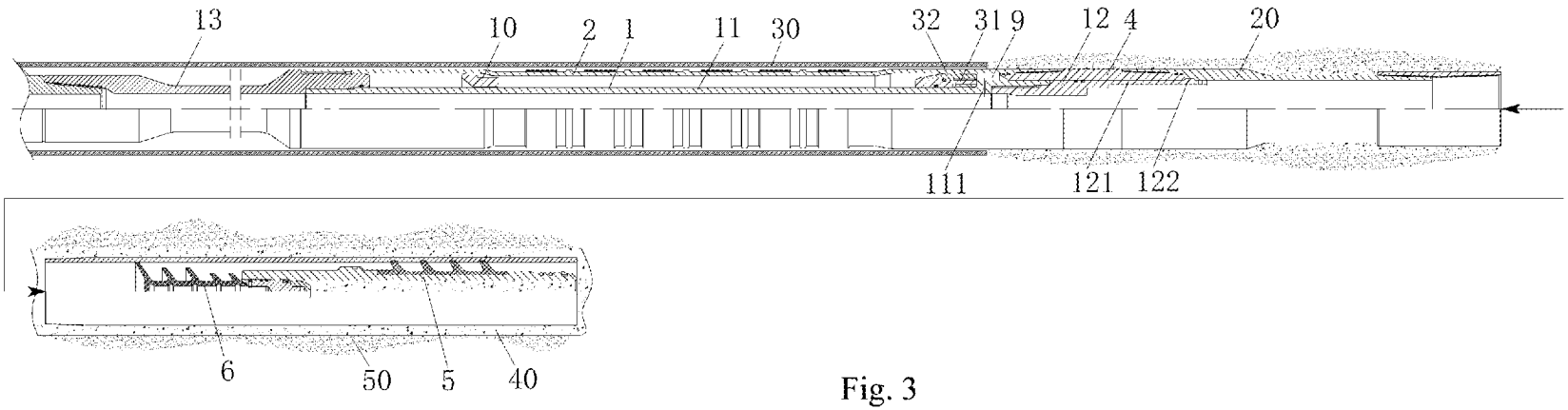
FIG. 3 is a schematic diagram illustrating the expandable liner hanger provided in the present invention in a well cementing state.

During well cementing operation, as shown in FIGS. 1-3, after the hanger is lowered into the well, cement slurry is injected into the well and flows along the central pipe 1 into the center hole of the cementing accessory 5, and then flows through the well cementing accessory 5 to the space at the lower end of the well cementing accessory 5. After the injection of the cement slurry is finished, the rubber plug 6 is thrown into the well, the rubber plug 6 moves into the well cementing accessory 5 under the hydraulic pressure, and is stopped by the well cementing accessory 5 from moving further. Specifically, a snap groove may be arranged in the center hole of the well cementing accessory 5, and a snap ring may be arranged on the surface of the rubber plug 6. After one end of the rubber plug 6 enters into the center hole of the well cementing accessory 5, the snap groove is fitted with the snap ring, so that the rubber plug 6 can't move downward further. Of course, to ensure successful pressurized operation, sealing is required between the well cementing accessory 5 and the rubber plug 6; moreover, at least one of the well cementing accessory 5 and the rubber plug 6 must be sealed against the external wellbore wall. Specifically, seal rings may be provided or the structures of the well cementing accessory 5 and rubber plug 6 may be configured to fit with the external wellbore wall to realize sealing.

After the rubber plug 6 is fitted with the well cementing accessory 5, water or displacement mud is pumped further into the central pipe 1, and the hydraulic pressure above the rubber plug 6 starts to increase, indicating the rubber plug sealing is successful. As the pressure is further increased, the shear pin 7 between the well cementing accessory 5 and the central pipe 1 is sheared off, the well cementing accessory 5 and the rubber plug 6 together are pushed into the bottom of the well, the cement slurry 40 at the lower end of the well cementing accessory 5 is pushed out of the liner, so that the liner 20 in the well is cemented to the rock formation 50 outside the liner 20, and thereby the well cementation is accomplished.

After the well cementing operation is finished, the liner hanging process of the hanger is executed. As shown in FIG. 4, water or displacement mud is pumped further into the center hole, the liquid flows through the aperture 111 in the side wall of the central pipe 1 into the cavity 9, and thereby the pressure in the cavity 9 is increased continuously. When the pressure reaches to the expansion actuation pressure, the expansion cone 3 is pushed under the pressure to move upward along the central pipe 1. The expandable pipe 2 is expanded under the mechanical action of the expansion cone 3. the central pipe 1 can be lifted upward in the expansion process, and the central pipe 1 and the expansion cone 3 moves upward together, and thereby increase the force for the expansion cone 3, so that the expansion operation can be accomplished as quickly as possible and overcome any potential tight hole situation. After the expansion is accomplished, the expansion cone 3 and the central pipe 1 may be lifted out of the expandable pipe 2 together, and the pressure in the central pipe 1 is decreased accordingly. Then, the expansion cone 3 and the central pipe 1 may be lifted out of the well. Thus, the liner hanging operation is accomplished. At this point, the expandable pipe 2 is tightly fixed to the external casing 30 via the external metal seal ring 21 and elastic seal ring 22 outside the expandable pipe 2.

Figure 6:
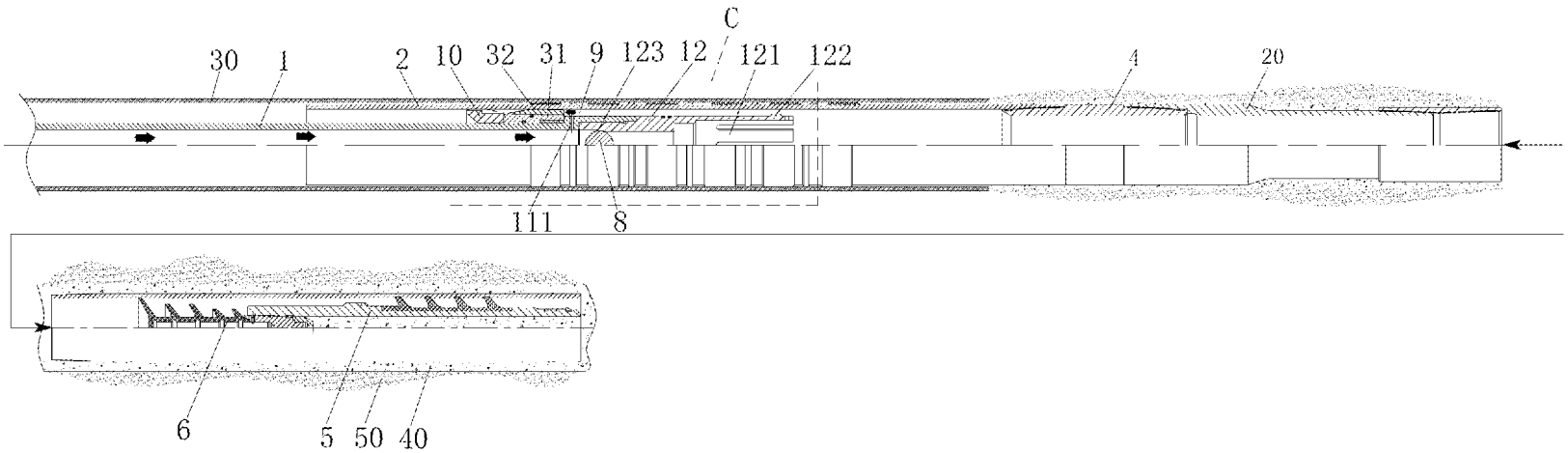
FIG. 6 is a schematic diagram illustrating the expansion of the expandable liner hanger provided in the present invention utilizing the tripping ball.
Figure 7:
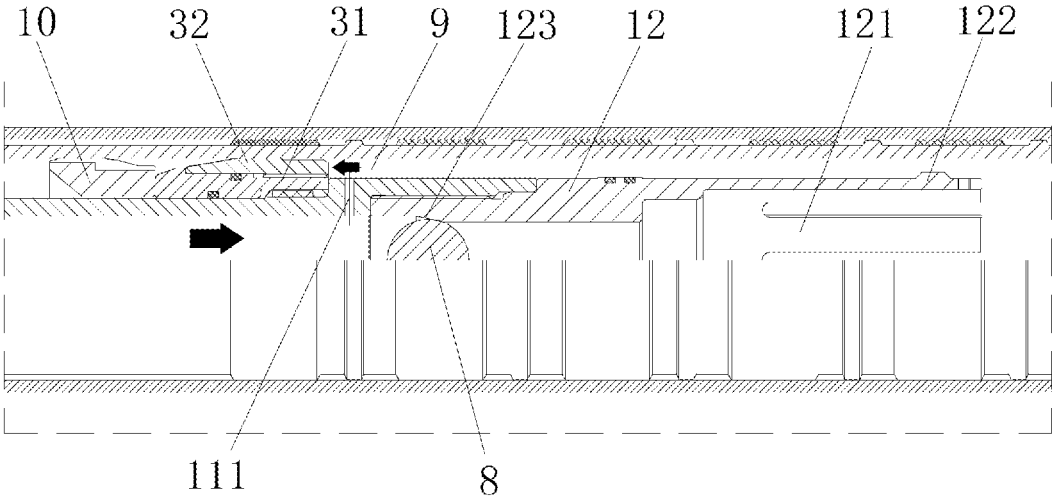
FIG. 7 is an enlarged view of portion C in FIG. 6.

In the technical scheme provided in the present invention, as shown in FIGS. 6 and 7, the expandable liner hanger further comprises a tripping ball 8 to be placed in the central pipe 1, and the central pipe 1 has a stop structure therein to stop the tripping ball 8 below the aperture 111, and the internal fluid passage in the central pipe 1 can be blocked when the tripping ball 8 is fitted with the stop structure.

Preferably, the stop structure is a tapered hole section 123 that is tapered in the downward direction in the carrying sleeve 12 at the lower end of the central pipe 1.

If wellbore pressure integrity fails post cement displacement and the expansion can not be initiated, the tripping ball 8 may be deployed into the central pipe 1. The tripping ball 8 is seized by the tapered hole section 123 when it moves downward to the tapered hole section 123 in the central pipe 1, and thereby blocks the channel in the central pipe 1. As water or mud is injected into the central pipe 1, the hydraulic pressure above the tripping ball 8 is increased continuously, and the fluid flows through the aperture 111 of the central pipe 1 into the fluid-filled cavity 9, so that the pressure in the cavity 9 is increased and reached to the expansion pressure, and the expansion cone 3 is pushed to move upward and thereby the expandable pipe 2 is expanded. Likewise, the central pipe 1 may be lifted upward so as to accelerate the expansion process.

Figure 8:
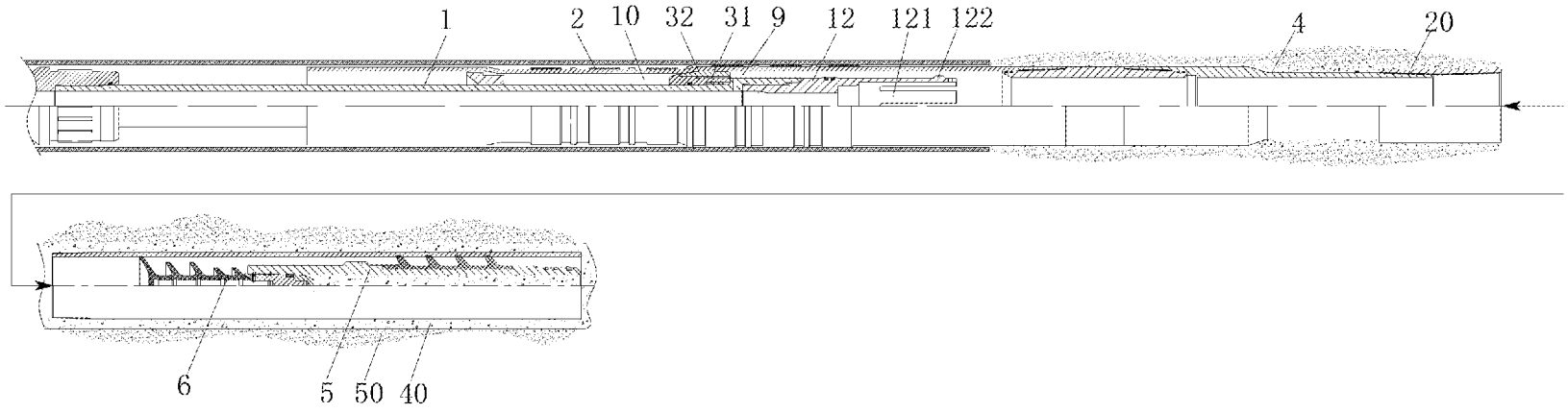
FIG. 8 is a schematic diagram illustrating the expandable liner hanger provided in the present invention in a state that the expansion cone can't move further to achieve expansion.

If the expansion cone 3 can't move further and the expandable pipe 2 can't expand owing to any obstruction (e.g., sand and gravel are entrained between the expandable pipe 2 and the central pipe 1) or the expansion cone 3 is stuck. As shown in FIG. 8, the central pipe 1 may be rotated so that the expansion cone seat 31 on the central pipe 1 is screwed out of the expansion cone sleeve 32 and the expansion cone seat 31 and the central pipe 1 are lifted out of the well together, alternatively the central pipe 1 overpulls the expansion seat 31 mechanically to break preinstalled shear pins (not shown).

Figure 9:
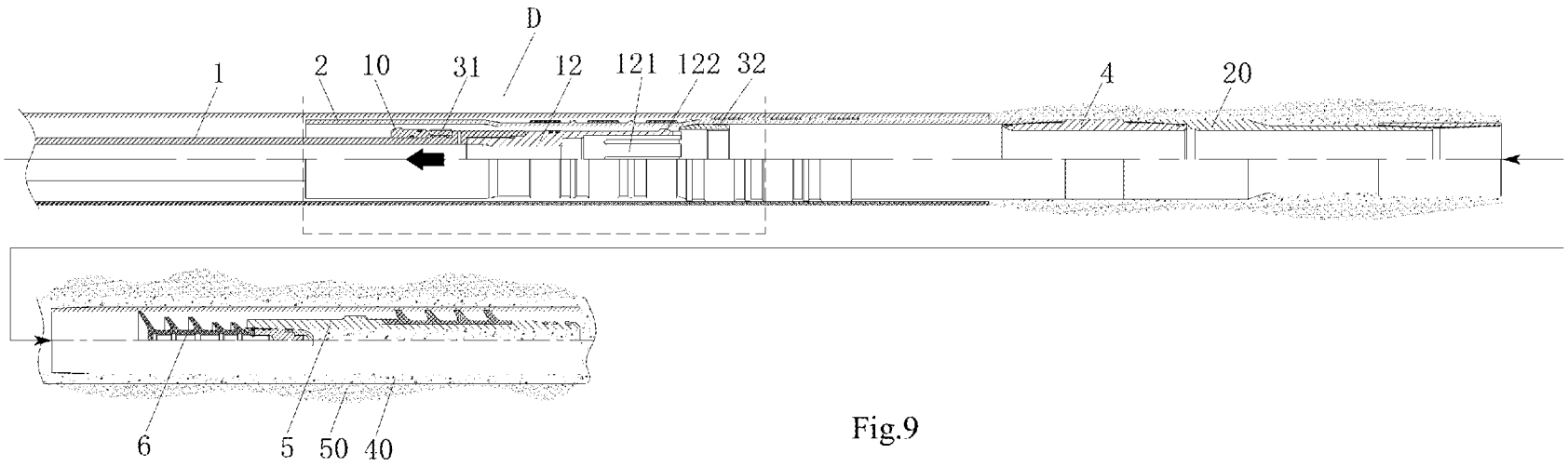
FIG. 9 is a schematic diagram illustrating a state that the expansion cone seat is driven by the central pipe to disengage from the expansion cone sleeve and move upward.
Figure 10:
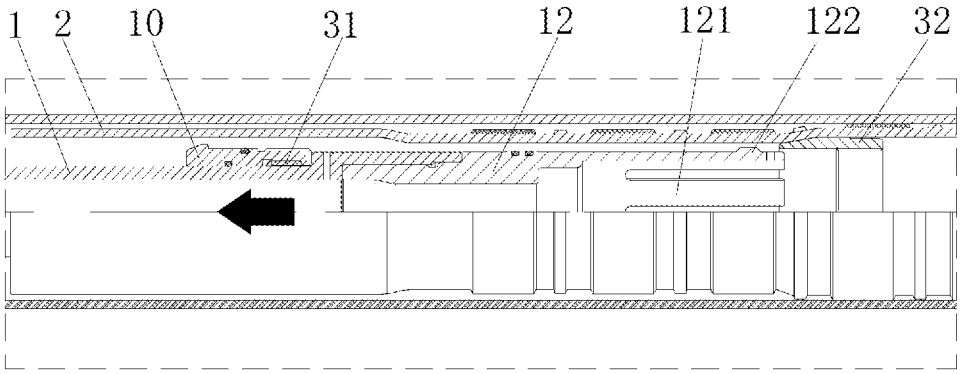
FIG. 10 is an enlarged view of portion D in FIG. 9.

Now, the expansion cone seat 31 and the central pipe 1 may be lifted out of the well, while the expansion cone sleeve 32 is left in the well, as shown in FIGS. 9 and 10.

While the present invention is described above in detail in some preferred embodiments with reference to the accompanying drawings, the present invention is not limited to those embodiments. Various simple variations may be made to the technical scheme in the present invention, including combinations of the specific technical features in any appropriate form, within the scope of the technical ideal of the present invention. To avoid unnecessary repetition, the possible combinations are not described specifically in the present invention. However, such simple variations and combinations shall also be deemed as having been disclosed and falling in the scope of protection of the present invention.

The invention claimed is:

1. An expandable liner hanger system, comprising a central pipe and an expandable pipe outside the central pipe, with an expansion cone provided between the central pipe and the expandable pipe in a way that the expansion cone is movable along the central pipe, so that the expandable pipe is expanded;

wherein, the expansion cone comprises an expansion cone seat that can move along the central pipe, and an expansion cone sleeve fitted over the expansion cone seat, the connection between the expansion cone seat and the expansion cone sleeve is configured in a way that the expansion cone sleeve can move upward together with the expansion cone seat along the central pipe so that the expandable pipe is expanded, and the central pipe can drive the expansion cone seat to rotate so as to disengage from the expansion cone sleeve.

2. The expandable liner hanger system of claim 1, wherein, the expansion cone seat is connected with the expansion cone sleeve via a threaded connection, the central pipe can drive the expansion cone seat to rotate such that the expansion cone seat can screwed out from the expansion cone sleeve.

3. The expandable liner hanger system of claim 2, wherein, a step is formed on the external surface of the central pipe [[(1), the expansion cone seat is at the upper end of the step and the expansion cone seat is fitted and connected with the central pipe via a spline so as to transmit rotating torque from the central pipe.

4. The expandable liner hanger system of claim 1, wherein, the expansion cone seat is connected with the expansion cone sleeve via at least one shear pin, the central pipe is configured such that the shear pin can be broken and the expansion cone seat can disengage from the expansion sleeve when rotating, pulling or pushing the expansion cone seat by the central pipe.

5. The expandable liner hanger system of claim 1, wherein, a fluid-filled cavity is formed between the central pipe and the expandable pipe at the side of the lower end of the expansion cone [[(3), the side wall of the central pipe has an aperture that communicates with the fluid-filled cavity [[(9), and the fluid flowing into the central pipe can enter into the fluid-filled cavity via the aperture and push the lower end of the expansion cone to move upward.

6. The expandable liner hanger system of claim 5, further comprising a well cementing accessory and a rubber plug [[(6), the well cementing accessory is connected to the lower end of the central pipe and has a center hole, and the rubber plug is used to be placed in the central pipe and can move to the well cementing accessory under the action of the pressurized fluid in the central pipe so as to be stopped by the well cementing accessory;

wherein, the well cementing accessory is connected to the central pipe via a shear pin [[(7), which can be sheared off when the rubber plug and the well cementing accessory are pushed to move under the pressure effect of the fluid above the rubber plug.

7. The expandable liner hanger system of claim 6, wherein, the central pipe comprises a main pipe body and a carrying sleeve connected to a lower end of the main pipe body [[(11), and the well cementing accessory is connected to the carrying sleeve via the shear pin [[(7).

8. The expandable liner hanger system of claim 7, wherein the lower end of the expandable pipe is connected with a connecting sleeve configured to connect a liner [[(20), the lower end of the carrying sleeve is divided along the circumferential direction to form a plurality of collet fingers [[(121), and a collet finger head configured to stop at the lower end face of the connecting sleeve is provided on the outer surface of at least one of the collet fingers [[(121);

when the central pipe moves upward after the well cementing accessory disengages downward from the carrying sleeve [[(12), the collet fingers can deform inward so that the collet finger heads move upward out of the lower end of the double pin thread connecting sleeve.

9. The expandable liner hanger system of claim 8, wherein, the carrying sleeve is connected with the main pipe body through a threaded connection; or, the connecting sleeve is connected with the expandable pipe through a threaded connection.

10. The expandable liner hanger system of claim 5, further comprising a tripping ball to be placed in the central pipe [[(1), and the central pipe is provided with a stop structure therein, which is configured to stop the tripping ball below the aperture [[(111), and the internal flow passage in the central pipe can be blocked when the tripping ball is fitted with the stop structure.

11. The expandable liner hanger system of claim 10, wherein, the central pipe comprises a main pipe body and a carrying sleeve connected to the lower end of the main pipe body [[(11), and the stop structure is a tapered hole section that is tapered in the downward direction in the carrying sleeve.

12. The expandable liner hanger system of claim 5, wherein, a dual-purpose sleeve that supports between the central pipe and the expandable pipe is provided at a side of the upper end of the expansion cone [[(3), the dual-purpose sleeve acts as a centralizer and also a debris catcher to prevent any solids falling into the critical expandable interval.

13. The expandable liner hanger system of claim 1, wherein, the central pipe further comprises a connecting pipe configured to connect a drill rod, the connecting pipe is provided at an upper end of the central pipe.

* * * * *